US007193600B2

(12) United States Patent
Onishi et al.

(10) Patent No.: US 7,193,600 B2
(45) Date of Patent: Mar. 20, 2007

(54) DISPLAY DEVICE AND PIXEL CORRESPONDING DISPLAY DEVICE

(75) Inventors: Yasuo Onishi, Kyoto (JP); Atsushi Koike, Katano (JP); Nobukazu Hosoya, Nara (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 444 days.

(21) Appl. No.: 09/774,099

(22) Filed: Jan. 31, 2001

(65) Prior Publication Data

US 2002/0018038 A1 Feb. 14, 2002

(30) Foreign Application Priority Data

Feb. 3, 2000 (JP) ..... 2000-025906
Mar. 13, 2000 (JP) ..... 2000-068937

(51) Int. Cl.
*G09G 3/36* (2006.01)
*G09G 5/00* (2006.01)

(52) U.S. Cl. ..... 345/99; 345/212

(58) Field of Classification Search ..... 345/211–213, 345/99

See application file for complete search history.

(56) References Cited

U.S. PATENT DOCUMENTS 5,854,618 A 12/1998 Kiwiet et al.
5,987,624 A 11/1999 Eglit

FOREIGN PATENT DOCUMENTS

| | | |
|---|---|---|
| EP | 0 712 108 | 5/1996 |
| EP | 0 791 913 | 8/1997 |
| EP | 0 791 913 A2 | 8/1997 |
| EP | 0 805 430 | 11/1997 |
| EP | 0 805 430 A1 | 11/1997 |
| EP | 0 953 963 | 11/1999 |
| EP | 0 953 963 A1 | 11/1999 |
| JP | 7-264440 | 10/1995 |
| JP | 11-311967 | 11/1999 |

*Primary Examiner*—Sumati Lefkowitz
*Assistant Examiner*—Srilakshmi K. Kumar
(74) *Attorney, Agent, or Firm*—Westerman, Hattori, Daniels & Adrian, LLP.

(57) ABSTRACT

A display device comprises horizontal video end position detection means for detecting a horizontal video end position of video data on the basis of a second threshold value and threshold value control means for controlling the second threshold value depending on the level of video data outputted from an analog-to-digital converter.

8 Claims, 10 Drawing Sheets

DISPLAY DEVICE AND PIXEL CORRESPONDING DISPLAY DEVICE

BACKGROUND OF THE INVENTION

1. Field of the Invention

The present invention relates generally to a display device, and particularly, to a liquid crystal display device capable of suitably displaying video (an image) irrespective of the total number of dots in a horizontal period of an input video signal.

The present invention further relates to a pixel corresponding display device for displaying video in units of pixels, and particularly, to a pixel corresponding display device for suitably displaying video by always keeping a phase relationship between a clock signal in a case where an inputted video signal is subjected to analog-to-digital conversion (hereinafter referred to as A/D conversion) and pixels composing a video signal in a stable state.

2. Description of the Prior Art

[1] In a liquid crystal display device, one of dots represented by dot data of an input video signal and one of pixels composing a liquid crystal panel are synchronized with each other in one horizontal scanning period, to display video. Line data representing one horizontal scan line out of an arbitrary number of line data in one vertical scanning period of the input video signal is displayed in correspondence with one line in the vertical direction of the liquid crystal panel. The line data is a collection of pixel data.

In recent years, computers with a large variety of specifications have been fabricated. A video a signal shown in FIG. 1*a* and a video signal shown in FIG. 1*b* differ in the total number of dots in a horizontal period (hereinafter referred to as the total of horizontal dots), for example, even if they are XGA (Extended Graphic Array) video signals outputted from various types of computers. In the XGA video signals, the respective total numbers of dots within a video effective period in the horizontal period (hereinafter referred to as the number of horizontal effective dots) are common. That is, the number of horizontal effective dots of the XGA video signal is 1024.

Sampling clocks for sampling 1024 dots within the video effective period in the horizontal period of the inputted XGA video signal are generated on the basis of a horizontal synchronizing signal of the inputted XGA video signal. Consequently, a method of generating the sampling clocks must be changed depending on the total of horizontal dots of the inputted XGA video signal. Therefore, it is necessary to recognize the total of horizontal dots of the inputted XGA video signal in order to generate the sampling clocks.

Conventionally, a table storing the total of horizontal dots has been prepared for each of types of XGA video signals, the type of the XGA video signal is judged from the characteristics of the XGA video signal inputted from the computer, and the total of horizontal dots corresponding to the judged type is selected from the table, thereby recognizing the total of horizontal dots of the inputted XGA video signal. However, this method cannot cope with the XGA video signal generated by a computer with a new specification.

Therefore, the applicant of the present invention has developed a method of generating sampling clocks suitable for a plurality of types of video signals whose number of horizontal effective dots has been known and which differ in the total of horizontal dots, to file an application (see JP-A-11-311967).

Specifically, a horizontal video start position HS (see FIGS. 1*a* and 1*b*) and a horizontal video end position HE (see FIGS. 1*a* and 1*b*) are detected for each of horizontal lines, to calculate the number of sampling clocks corresponding to the distance from a horizontal video start position and a horizontal video end position of an input video signal on the basis of the horizontal video start position and the horizontal video end position which have been detected.

When the number of sampling clocks corresponding to the distance between the horizontal video start position and the horizontal video end position of the input video signal is smaller than the known number of horizontal effective dots "1024", the frequency of the sampling clocks is controlled in such a direction as to be increased. When the number of sampling clocks corresponding to the distance between the horizontal video start position and the horizontal video end position of the input video signal is larger than "1025" which is larger by one than the known number of horizontal effective dots, the frequency of the sampling clocks is controlled in such a direction as to be decreased.

A When the number of sampling clocks corresponding to the distance between the horizontal video start position and the horizontal video end position of the input video signal coincides with 1024 or 1025, the phase of the clocks is delayed by a value corresponding to at least one clock in several nano units.

The horizontal video start position and the horizontal video end position of the input video signal are detected by comparing the input video data after the AD conversion by the A/D converter with a predetermined threshold value. However, the position detection precision is greatly affected depending on how an analog input video signal inputted to the A/D converter is dull.

Threshold values used for detecting the horizontal video start position and the horizontal video end position of the input video signal have been conversely fixed, and are forced to be determined so as to be adapted to an input video signal having a low luminance out of input video signals. Accordingly, the dullness of the analog input video signal inputted to the A/D converter greatly affects the position detection precision.

Since the dullness significantly appears at the falling edge of the analog input video signal, the detection precision of the horizontal video end position is particularly decreased in the conventional example.

[2] In a liquid crystal display which is one type of pixel corresponding display device, one of pixels represented by pixel data of a video signal and one of pixels composing a liquid crystal panel are synchronized with each other in one horizontal scanning period, to display video. Line data representing one horizontal scan line (hereinafter referred to as a line) out of an arbitrary number of line data in one vertical scanning period of the video signal is displayed in correspondence with one line in the vertical direction of the liquid crystal panel. The line data is a collection of pixel data.

Data handled inside by a computer is a digital signal, and the video signal is also generated as a digital signal in units of pixels. However, a CRT display which has been conventionally used as a display device is an analog device. Accordingly, the video data generated in the computer is converted into an analog video signal in the computer, to output the analog video signal to the CRT display.

On the other hand, the liquid crystal display is a digital device. Accordingly, the video signal fed as an analog signal from the computer must be subjected to A/D conversion. Therefore, sampling clocks for performing the A/D conversion must be reproduced on the side of the display. Conventionally, the sampling clocks for performing A/D conversion have been reproduced on the basis of only a horizontal synchronizing signal. However, it is not ensured that the phase relationship between the horizontal synchronizing signal and pixels composing the analog video signal is always kept in a correct state, and the total number of clocks within one horizontal period is unclear. Consequently, a system for adjusting the frequency and the phase of the clocks is required.

The following is a method of automatically adjusting the frequency and the phase of the sampling clocks in response to an input signal. The total of sampling clocks in one horizontal period is adjusted to adjust the frequency of the sampling clocks such that the number of horizontal effective pixels composing input video reaches a predetermined value. A horizontal synchronizing signal of an input video signal is fed to a sampling clock generation circuit through a delay circuit, and the amount of delay in the delay circuit is adjusted, to adjust the phase of the sampling clocks.

However, the input signal must satisfy the following conditions in order to accurately adjust the frequency and the phase of the sampling clocks in this method.

Condition 1; In order to accurately detect the number of horizontal effective pixels, at least one horizontal effective start point whose level exceeds a threshold level for horizontal effective start point judgment and at least one horizontal effective end point whose level exceeds a threshold level for horizontal effective end point judgment exist within one field period in the input video.

Condition 2; the first condition is satisfied continuously for a plurality of field periods.

In the case of almost all screen saver images, for example, an object is to prevent a CRT from being seized. Accordingly, a frame whose position is fixed is not displayed, a background image is taken as an image whose level is close to a black level, and an image to be displayed is further displayed as a moving image. When the screen saver image is inputted, therefore, the number of horizontal effective pixels cannot be accurately detected.

Furthermore, a horizontal RAMP image has no sharp edge for specifying a horizontal video start position or a horizontal video end position, and is easily affected by a noise component or a horizontal jitter component. When the horizontal RAMP image is inputted, therefore, the number of horizontal effective pixels cannot be accurately detected.

That is, it has been conventionally impossible to distinguish a special video signal and a normal video signal, described above. Accordingly, accurate clock automatic adjustment cannot be performed.

SUMMARY OF THE INVENTION

An object of the present invention is to provide a display device capable of improving the detection precision of a horizontal video end position.

Another object of the present invention is to provide a pixel corresponding display device capable of properly judging video in which the difference between a horizontal video start position and a horizontal video end position whose level exceeds the threshold level of an input video signal is smaller than the number of horizontal effective pixels (for example, a screen saver image), properly switching an executed/stopped state of a clock automatic adjustment operation depending on the result of the judgment, to prevent the clock automatic adjustment from being erroneously performed, and accurately performing sampling clock adjustment.

A first display device according to the present invention is characterized by comprising a clock generation circuit for generating sampling clocks, whose frequency is controlled on the basis of a required frequency control value, on the basis of a horizontal synchronizing signal of an input video signal; an analog-to-digital converter, for sampling the input video signal on the basis of the sampling clocks generated from the clock generation circuit; horizontal video start position detection means for detecting a horizontal video start position of video data outputted from the analog-to-digital converter on the basis of a first threshold value; horizontal video end position detection means for detecting a horizontal video end position of the video data outputted from the analog-to-digital converter on the basis of a second threshold value; calculation means for calculating the number of sampling clocks corresponding to the distance from the horizontal video start position to the horizontal video end position; judgment means for judging whether or not the result of the calculation by the calculation means coincides with a required reference value; frequency control value adjustment means for calculating, when it is judged that the result of the calculation by the calculation means and the reference value do not coincide with each other, a new frequency control value on the basis of the result of the calculation by the calculation means, the reference value, and the frequency control value currently set in the clock generation circuit, to feed the new frequency control value to the clock generation circuit; and threshold value control means for controlling, for each vertical period, the second threshold value depending on the level of the video data at the horizontal video end position detected within the period.

An example of the clock generation circuit is one comprising a voltage controlled oscillator for outputting the sampling clocks, a frequency divider for dividing the frequency of the sampling clocks outputted from the voltage controlled oscillator, phase detection means, to which an output of the frequency divider and the horizontal synchronizing signal of the input video signal are inputted, for outputting a detection signal corresponding to the phase difference between both the inputted signals, and filter means for integrating the detection signal outputted from the phase detection means, to output the integrated detection signal to the voltage controlled oscillator. In this case, the frequency division ratio of the frequency divider is used as the frequency control value.

A second display device according to the present invention is characterized by comprising a clock generation circuit for generating sampling clocks, whose frequency is controlled on the basis of a required frequency control value, on the basis of a horizontal synchronizing signal of an input video signal; an analog-to-digital converter for sampling the input video signal on the basis of the sampling clocks generated from the clock generation circuit; a horizontal video start position detection circuit for detecting a horizontal video start position of video data outputted from the analog-to-digital converter on the basis of a first threshold value; a horizontal video end position detection circuit for detecting a horizontal video end position of the video data outputted from the analog-to-digital converter on the basis of a second threshold value; a calculation circuit for calculating the number of sampling clocks corresponding to the distance from the horizontal video start position to the horizontal video end position; a judgment circuit for judging whether or not the result of the calculation by the calculation means coincides with a required reference value; a frequency control value adjustment circuit for calculating, when it is judged that the result of the calculation by the calculation circuit and the reference value do not coincide with each other, a new frequency control value on the basis of the result of the calculation by the calculation circuit, the reference value, and the frequency control value currently set in the clock generation circuit, to feed the new frequency control value to the clock generation circuit; and a threshold value control circuit for controlling, for each vertical period, the second threshold value depending on the level of the video data at the horizontal video end position detected within the vertical period.

An example of the clock generation circuit is one comprising a voltage controlled oscillator for outputting the sampling clocks, a frequency divider for dividing the frequency of the sampling clocks outputted from the voltage controlled oscillator, a phase detection circuit, to which an output of the frequency divider and the horizontal synchronizing signal of the input video signal are inputted, for outputting a detection signal corresponding to the phase difference between both the inputted signals, and a filter circuit for integrating the detection signal outputted from the phase detection circuit, to output the integrated detection signal to the voltage controlled oscillator. In this case, the frequency division ratio of the frequency divider is used as a frequency control value.

A first pixel corresponding display device according to the present invention is characterized by comprising a clock generation circuit for generating sampling clocks on the basis of a horizontal synchronizing signal of an input video signal; an analog-to-digital converter for sampling the input video signal on the basis of the sampling clocks generated from the clock generation circuit; detection means for comparing video data outputted from the analog-to-digital converter with a predetermined threshold value, to detect a horizontal video start position and a horizontal video end position on each of horizontal lines; calculation means for calculating, on the basis of a horizontal video start position closest to a horizontal period start position specified by the horizontal synchronizing signal out of horizontal video start positions detected within one field and a horizontal video end position farthest from the horizontal period start position specified by the horizontal synchronizing signal out of horizontal video end positions detected within one field, the number of sampling clocks corresponding to the distance between the horizontal video start position and the horizontal video end position of the input video signal for the field; frequency adjustment means for controlling the clock generation circuit on the basis of the result of the calculation by the calculation means, to adjust the frequency of the sampling clocks; judgment means for judging for each field whether or not the width of a region where input video exists is smaller than the number of horizontal effective pixels on the basis of the result of the calculation by the calculation means; and means for stopping, while the width of the region where the input video exists is being judged to be smaller than the number of horizontal effective pixels, a frequency adjustment operation based on the number of sampling clocks found in the field.

A second pixel corresponding display device according to the present invention is characterized by comprising a clock generation circuit for generating sampling clocks on the basis of a horizontal synchronizing signal of an input video signal; an analog-to-digital convener for sampling the input video signal on the basis of the sampling clocks generated from the clock generation circuit; a detection circuit for comparing video data outputted from the analog-to-digital converter with a predetermined threshold value, to detect a horizontal video start position and a horizontal video end position on each of horizontal lines; a calculation circuit for calculating, on the basis of a horizontal video start position closest to a horizontal period start position specified by the horizontal synchronizing signal out of horizontal video start positions detected within one field and a horizontal video end position farthest from a horizontal period start position specified by the horizontal synchronizing signal out of horizontal video end positions detected within one field, the number of sampling clocks corresponding to the distance between the horizontal video start position and the horizontal video end position of the input video signal for the field; a frequency adjustment circuit for controlling the clock generation circuit on the basis of the result of the calculation by the calculation circuit, to adjust the frequency of the sampling clocks; a judgment circuit for judging for each field whether or not the width of a region where input video exists is smaller than the number of horizontal effective pixels on the basis of the result of the calculation by the calculation circuit; and a circuit for stopping, while the width of the region where the input video exists is being judged to be smaller than the number of horizontal effective pixels, a frequency adjustment operation based on the number of sampling clocks found in the field.

A third pixel corresponding display device according to the present invention is characterized by comprising a delay circuit, whose amount of delay is variable, for delaying and outputting a horizontal synchronizing signal of an input video signal; a clock generation circuit for generating sampling clocks which are synchronized with the horizontal synchronizing signal outputted from the delay circuit; an analog-to-digital converter for sampling the input video signal on the basis of the sampling clocks generated from the clock generation circuit; detection means for comparing video data outputted from the analog-to-digital converter with a predetermined threshold value, to detect a horizontal video start position and a horizontal video end position on each of horizontal lines; calculation means for calculating, on the basis of a horizontal video start position closest to a horizontal period start position specified by the horizontal synchronizing signal outputted from the delay circuit out of horizontal video start positions detected within one field and a horizontal video end position farthest from a horizontal period start position specified by the horizontal synchronizing signal outputted from the delay circuit out of horizontal video end positions detected within one field, the number of sampling clocks corresponding to the distance between the horizontal video start position and the horizontal video end position of the input video signal for the field; phase adjustment means for changing an amount of delay set in the delay circuit a predetermined amount at a time for each field, to change the phase of the sampling clocks a predetermined amount at a time for the field, holding as a first amount of delay the amount of delay set in the delay circuit in the field in a case where the number of sampling clocks calculated by the calculation means is changed in such a direction as to be decreased and holding as a second amount of delay the amount of delay set in the delay circuit in the field in a case where the number of sampling clocks calculated by the calculation means is changed in such a direction as to be increased, and calculating the average sum of the first amount of delay and the second amount of delay, to set the amount of delay set in the delay circuit to the obtained average sum; judgment means for judging for each field whether or not the width of a region where input video exists is smaller than the number of horizontal effective pixels on the basis of the result of the calculation by the calculation means; and means for stopping, when it is judged that the width of the region where the input video exists is smaller than the number of horizontal effective pixels, a phase adjustment operation based on the number of sampling clocks found in the field.

A fourth pixel corresponding display device according to the present invention is characterized by comprising a delay circuit, whose amount of delay is variable, for delaying and outputting a horizontal synchronizing signal of an input video signal; a clock generation circuit for generating sampling clocks which are synchronized with the horizontal synchronizing signal outputted from the delay circuit; an analog-to-digital converter for sampling the input video signal on the basis of the sampling clocks generated from the clock generation circuit; a detection circuit for comparing video data outputted from the analog-to-digital converter with a predetermined threshold value, to detect a horizontal video start position and a horizontal video end position on each of horizontal lines; a calculation circuit for calculating, on the basis of a horizontal video start position closest to a horizontal period start position specified by the as horizontal synchronizing signal outputted from the delay circuit out of horizontal video start positions detected within one field and a horizontal video end position farthest from a horizontal period start position specified by the horizontal synchronizing signal outputted from the delay circuit out of horizontal video end positions detected within one field, the number of sampling clocks corresponding to the distance between the horizontal video start position and the horizontal video end position of the input video signal for the field; a phase adjustment circuit for changing an amount of delay set in the delay circuit a predetermined amount at a time for each field, to change the phase of the sampling clocks a predetermined amount at a time for the field, holding as a first amount of delay the amount of delay set in the delay circuit in the field in a case where the number of sampling clocks calculated by the calculation means is changed in such a direction as to be decreased and holding as a second amount of delay the amount of delay set in the delay circuit in the field in a case where the number of sampling clocks calculated by the calculation circuit is changed in such a direction as to be increased, and calculating the average sum of the first amount of delay and the second amount of delay, to set the amount of delay set in the delay circuit to the obtained average sum; a judgment circuit for judging for each field whether or not the width of a region where input video exists is smaller than the number of horizontal effective pixels on the basis of the result of the calculation by the calculation means; and a circuit for stopping, when it is judged that the width of the region where the input video exists is smaller than the number of horizontal effective pixels, a phase adjustment operation based on the number of sampling clocks found in the field.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENT

[1] Description of First Embodiment

Referring now to FIGS. 2 to 6, a first embodiment of the present invention will be described.

Figure 1A:
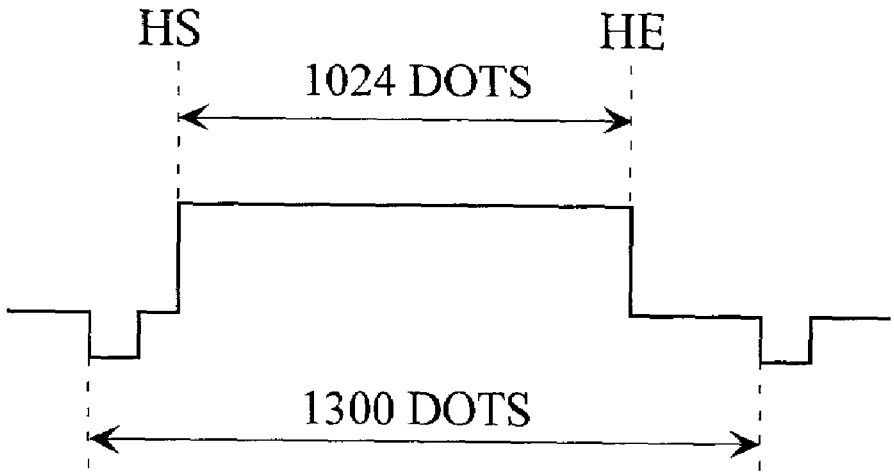
FIGS. 1*a* and 1*b* are timing charts showing XGA video signals which differ in the total of horizontal dots.
Figure 1B:
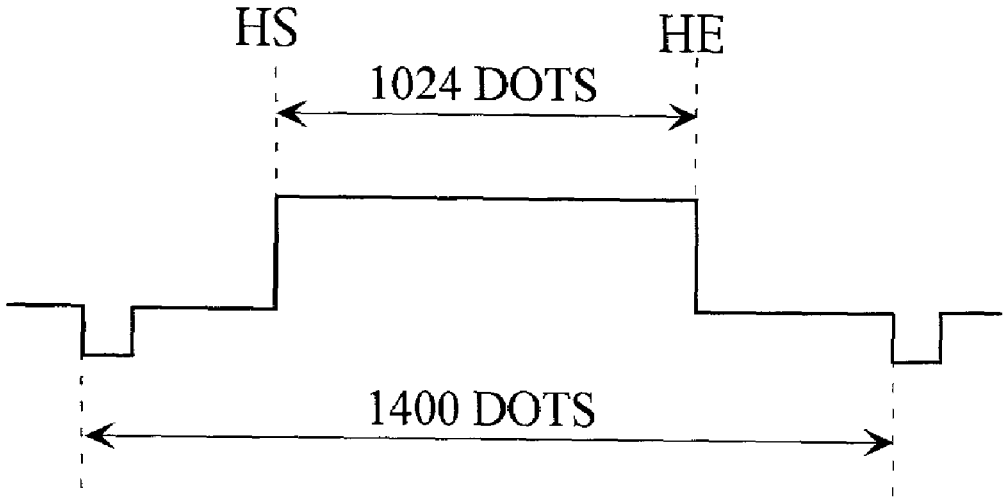
Figure 2:
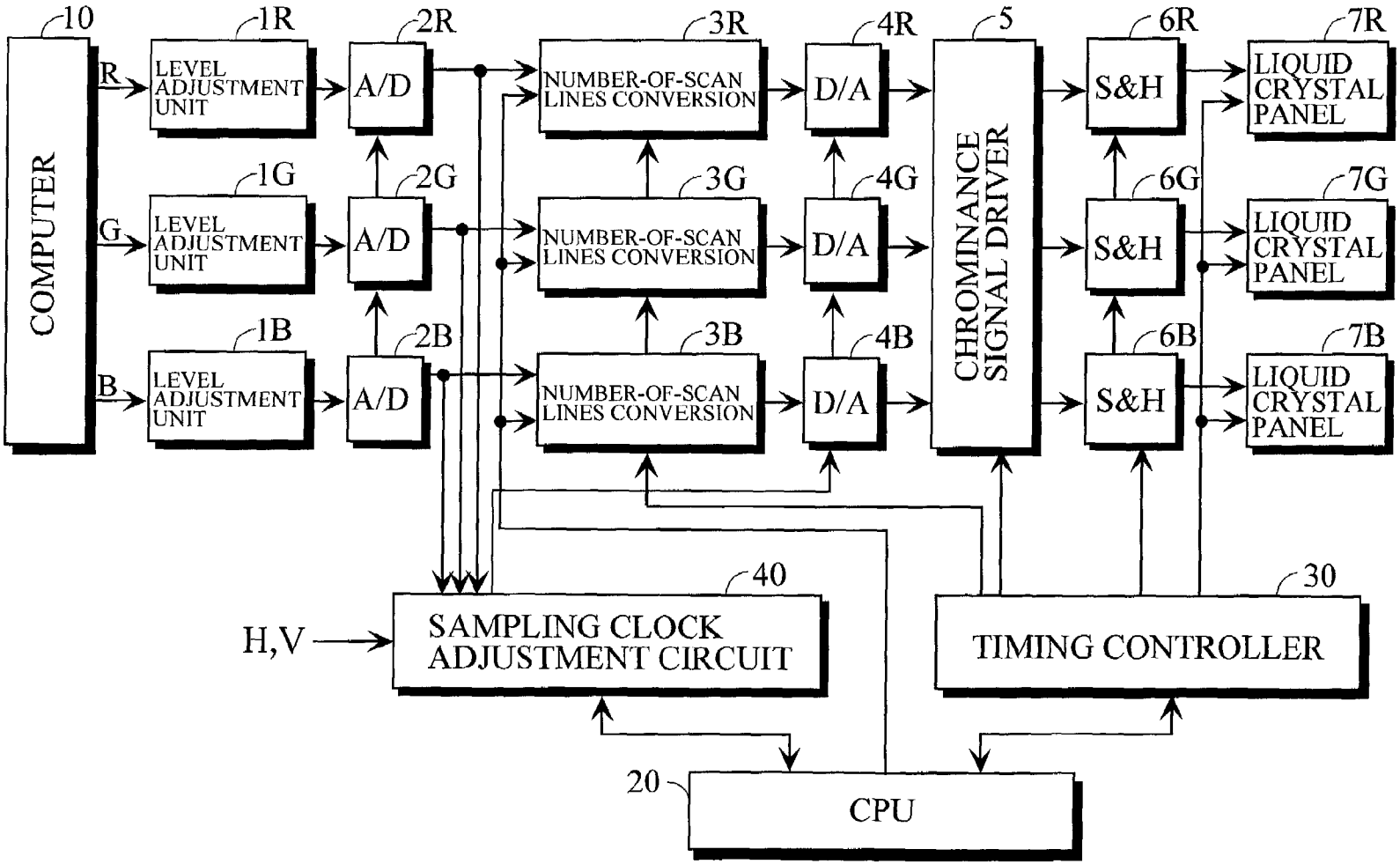
FIG. 2 is a block diagram showing the entire configuration of a liquid crystal display device.

FIG. 2 illustrates the entire configuration of a liquid crystal display device.

The levels of XGA video signals R, G, and B fed from a computer (hereinafter referred to as PC) 10 are respectively adjusted so as to conform to the input conditions of analog-to-digital (A/D) converters 2R, 2G, and 2B in the succeeding stage by level adjustment units 1R, 1G, and 1B. The video signals R, G, and B whose levels have been adjusted are respectively converted into digital video data R, G, and B by the A/D converters 2R, 2G, and 2B, and the digital video data are then respectively fed to number-of-scan lines conversion circuits 3R, 3G, and 3B.

In the number-of-scan lines conversion circuits 3R, 3G, and 3B, the respective scan lines of the video data R, G, and B are converted so as to be adaptable to liquid crystal panels 7R, 7G, and 7B. Outputs of the number-of-scan lines conversion circuits 3R, 30, and 3B are respectively converted into analog video signals R, G, and B by digital-to-analog (D/A) converters 4R, 4G, and 4B.

The video signals R, G, and B outputted from the D/A converters 4R, 4G, and 4B are respectively fed to the liquid crystal panels 7R, 7G, and 7B through a chrominance signal driver 5 and sample-and-hold circuits 6R, 6G, and 6B.

A timing signal is fed from a timing controller 30 to the number-of-scan lines conversion circuits 3R, 3G, and 3B, the chrominance signal driver 5, the sample-and-hold circuits 6R, 6G, and 6B, and the liquid crystal panels 7R, 7G, and 7B. Sampling clocks fed to the A/D converters 2R, 2G, and 2B and the D/A converters 4R, 4G, and 4B are generated by a sampling clock adjustment circuit 40. The timing controller 30 and the sampling clock adjustment circuit 40 are controlled by a CPU 20.

Figure 3:
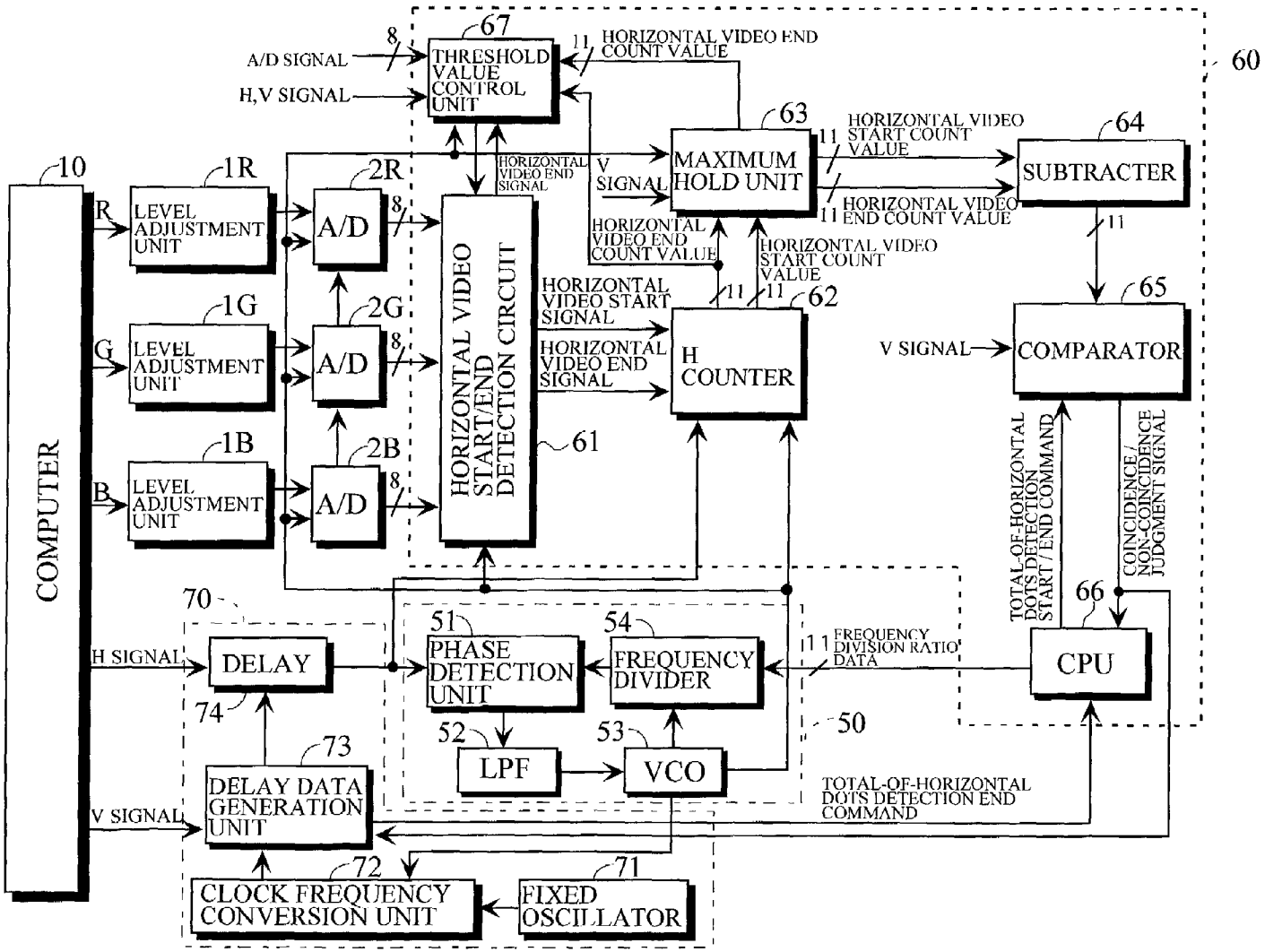
FIG. 3 is a block diagram showing the configuration of a sampling clock control circuit according to a first embodiment.

FIG. 3 illustrates the configuration of the sampling clock adjustment circuit 40.

The sampling clock adjustment circuit 40 is constituted by a PLL (Phase-Locked Loop) circuit 50 for outputting sampling clocks on the basis of a horizontal synchronizing signal (an H signal) of an input video signal inputted from the computer 10, a total-of-horizontal dots detection circuit 60 for adjusting the frequency of the sampling clocks outputted from the PLL circuit 50, and a phase control circuit 70 for controlling the phase of the sampling clocks outputted from the PLL circuit 50.

The phase control circuit 70 comprises a fixed oscillator 71, a clock frequency conversion unit 72 for detecting the frequency of the sampling clocks, a delay data generation unit 73 for determining the amount of unit delay on the basis of the frequency of the sampling clocks detected by the clock frequency conversion unit 72, and a delay circuit 74 for delaying the phase of the horizontal synchronizing signal on the basis of the amount of unit delay determined by the delay data generation unit 73.

The PLL circuit 50 comprises a phase detection unit 51, an LPF (Low Pass Filter) 52, a VCO (Voltage Controlled Oscillator) 53, and a frequency divider 54, as is well known. The phase detection unit 51 outputs a detection signal corresponding to the phase difference between the horizontal synchronizing signal fed through the delay circuit 74 and an output signal of the frequency divider 54. The LPF 52 integrates the detection signal from the phase detection unit 51. Sampling clocks having a frequency corresponding to the detection signal integrated by the LPF 52 are outputted to the VCO 53. The frequency divider 54 divides the frequency of the sampling clocks outputted from the VCO 53 on the basis of data representing a frequency division ratio (hereinafter referred to as frequency division ratio data) from the total-of-horizontal dots detection circuit 60 (total-of-horizontal dots detection data).

The total-of-horizontal dots detection circuit 60 comprises a horizontal video start/end detection circuit 61, an H counter 62, a maximum hold unit 63, a subtracter 64, a comparator 65, a CPU 66, and a threshold value control unit 67.

When a command to start the adjustment of the frequency of the sampling clocks is entered into the CPU 66, the CPU 66 outputs a command to start the detection of the total number of horizontal dots (hereinafter referred to as a total-of-horizontal dots detection start command). The total-of-horizontal dots detection start command is fed to the comparator 65. The comparator 65 is rendered active when it receives the total-of-horizontal dots detection start command.

The sampling clocks corresponding to the A/D converters 2R, 2G, and 2B are generated by the PLL circuit 50. A horizontal synchronizing signal corresponding to an input video signal is fed to the PLL circuit 50 through a delay circuit 74 in the phase control circuit 70. The PLL circuit 50 generates the sampling clocks on the basis of the horizontal synchronizing signal outputted from the delay circuit 74. The frequency of the sampling clocks is adjusted by the frequency division ratio data from the CPU 66 in the total-of-horizontal dots detection circuit 60. The phase of the sampling clocks is adjusted by changing the amount of delay in the delay circuit 74.

The digital data R, G, B respectively obtained by the A/D converters 2R, 2G, and 2B are fed to the horizontal video start/end detection circuit 61. The horizontal video start/end detection circuit 61 is provided to detect a horizontal video start position and a horizontal video end position for each of the horizontal lines on the basis of the output data of the A/D converters 2R, 2G, and 2B, Specifically, the horizontal video start/end detection circuit 61 outputs, when each of the inputted data R, G, and B is changed from a level lower than a predetermined threshold value for start position judgment to a level higher than the threshold value for start position judgment, a horizontal video start signal composed of a pulse signal corresponding to one sampling clock. After the horizontal video start signal is outputted by changing the inputted data from the level lower than the threshold value for start position judgment to the level higher than the threshold value for start position judgment, however, when the inputted data is maintained at the level higher than the threshold value for start position judgment, no horizontal video start signal is outputted. After the horizontal video start signal is outputted, when the inputted data is lower than the threshold value for start position judgment and then, exceeds the threshold value for start position judgment again, the horizontal video start signal is outputted again.

The horizontal video start/end detection circuit 61 outputs, when each of the inputted data R, G, and B is changed from a level higher than a predetermined threshold value for end position judgment to a level lower than the threshold value for end position judgment, a horizontal video end signal composed of a pulse signal corresponding to one sampling clock. The horizontal video start signal and the horizontal video end signal which are outputted from the horizontal video start/end detection circuit 61 are fed to the H counter 62.

When a large value is set as the threshold value for start position judgment or for end position judgment, data having a low luminance cannot be read. When a small value is set as the threshold value, noises may be read as data. Therefore, such a small value as to be slightly larger than the value of the noises is set as the threshold value. In the present embodiment, the threshold value for start position judgment which is used for detecting the horizontal video start position is fixed. However, the threshold value for end position judgment which is used for detecting the horizontal video end position is changed depending on the input video signal level by the threshold value control unit 67. The details of the operation of the threshold value control unit 67 will be described later.

The H counter 62 is reset every time the horizontal synchronizing signal is inputted from the delay circuit 74. The H counter 62 counts the number of sampling clocks inputted to the H counter 62. The H counter 62 feeds, when the horizontal video start signal is fed from the horizontal video start/end detection circuit 61, a count value at that time (the number of sampling clocks from the time point where the horizontal synchronizing signal from the delay circuit 74 is inputted to the time point where the horizontal video start signal is inputted) as a horizontal video start count value (11 bits) to the maximum hold unit 63.

The H counter 62 feeds, when the horizontal video end signal is fed from the horizontal video start/end detection circuit 61, a count value at that time (the number of sampling clocks from the time point where the horizontal synchronizing signal from the delay circuit 74 is inputted to the time point where the horizontal video end signal is inputted) as a horizontal video end count value (11 bits) to the maximum hold unit 63.

The maximum hold unit 63 holds the minimum value of horizontal video start count values inputted to the maximum hold unit 63. The operation shall be referred to as a minimum value holding operation. The horizontal video start count value held in the maximum hold unit 63 is initialized to an initial value (for example, "2047") when a vertical synchronizing signal (a V signal) is inputted.

Furthermore, the maximum hold unit 63 holds the maximum value of horizontal video end count values. The operation shall be referred to as a maximum value holding operation. The horizontal video end count value held in the maximum hold unit 63 is initialized to an initial value (for example, "0") when the vertical synchronizing signal (the V signal) is inputted.

The maximum hold unit 63 feeds the horizontal video start count value and the horizontal video end count value which are held to the subtracter 64. The subtracter 64 calculates the difference between the horizontal video start count value and the horizontal video end count value (the horizontal video end count value−the horizontal video start count value) which are fed from the maximum hold unit 63, and feeds the result of the operation to the comparator 65.

The comparator 65 judges, every time the vertical synchronizing signal (the V signal) is inputted, whether or not the result of the operation fed from the subtracter 64 coincides with a reference value. More specifically, it is judged whether or not the result of the subtraction fed from the subtracter 64 coincides with the number of horizontal effective dots composing the input video signal or a value larger than the number by one. In the following description, the type of the input video signal shall be an XGA video signal. In this case, the comparator 65 judges whether or not the result of the subtraction fed from the subtracter 64 coincides with the number of horizontal effective dots "1024" composing the XGA video signal or "1025" larger than the number by one.

When the result of the subtraction does not coincide with "1024" nor "1025", a coincidence/non-coincidence judgment signal is brought into an L level. When the result of the subtraction coincides with either "1024" or "1025", the coincidence/non-coincidence judgment signal is brought into an H level.

The result of the subtraction by the subtracter 64 is fed to the CPU 66 through the comparator 65. The coincidence/non-coincidence judgment signal from the comparator 65 is also fed to the CPU 66. The coincidence/non-coincidence judgment signal from the comparator 65 is also fed to the delay data generation unit 73.

The CPU 66 calculates the total of horizontal dots on the basis of the following equation (1):

$$\text{Total of horizontal dots} = \text{number of horizontal effective dots} \times (\text{current frequency division ratio}/\text{result of subtraction}) \quad (1)$$

The total of horizontal dots which has been calculated by the CPU 66 is inputted to the frequency divider 54 as frequency division ratio data. A default value of the total of horizontal dots is set at the time of initial setting. As the default value, a value close to a general total of horizontal dots composing the XGA video signal, for example, "1225" is set.

When the result of the subtraction coincides with "1024" or "1025" by performing such an operation, the coincidence/non-coincidence judgment signal is changed into an H level.

The delay data generation unit 73 controls, when the coincidence/non-coincidence judgment signal enters an H level, the delay circuit 74 such that the horizontal synchronizing signal is delayed in several nano units every time the vertical synchronizing signal (the V signal) is inputted in order to perform fine adjustment, as described later. Also in this case, the maximum hold unit 63, the subtracter 64, the comparator 65, and so forth perform the same operations as described above. At the time of the fine adjustment, when the coincidence/non-coincidence judgment signal enters an L level, that is, when the result of the subtraction is changed, the CPU 66 calculates the total of horizontal dots on the basis of the foregoing equation (1), to update the frequency division ratio data.

When the total of delay values reaches a predetermined value corresponding to not less than one sampling clock, the delay data generation unit 73 stops delay control, and feeds a command to end the detection of the total of horizontal dots (hereinafter referred to as a total-of-horizontal dots detection end command) to the CPU 66. The CPU 66 stores, when it receives the total-of-horizontal dots detection end command, the frequency division ratio data such that the frequency division ratio data is not changed, and feeds the total-of-horizontal dots detection end command to the comparator 65. The comparator 65 is rendered inactive when it receives the total-of-horizontal dots detection end command.

As described in the foregoing, delay control (fine adjustment) is carried out after the result of the subtraction by the subtracter 64 coincides with "1024" or "1025" from the following reasons. The waveform of an analog signal before sampling (A/D conversion) is dull, for example. Accordingly, the difference between the horizontal video start count value and the horizontal video end count value tends to be slightly larger than an actual number of dots "1024".

Even if the frequency of the sampling clocks is correct, therefore, it is considered that there are a case where the difference between the horizontal video start count value and the horizontal video end count value is "1024" and a case where it is "1025" depending on the phase of the sampling clocks based on the horizontal synchronizing signal.

When the difference between the horizontal video start count value and the horizontal video end count value is "1024" or "1025", it is considered that the frequency of the sampling clocks is suitable. In a case where it is judged that the difference between the horizontal video start count value and the horizontal video end count value is "1025", however, when the phase of the sampling clocks is changed, the difference between the horizontal video start count value and the horizontal video end count value may be "1026".

After it is judged that the difference between the horizontal video start count value and the horizontal video end count value is "1024" or "1025", the phase of the sampling clocks is changed within a predetermined range. Even if the difference between the horizontal video start count value and the horizontal video end count value is "1026", fine adjustment is performed such that the frequency of the sampling clocks is reduced.

The clock frequency conversion unit 72 generates a reference clock signal having a predetermined period width by dividing the frequency of clocks generated from the fixed oscillator 71. A counter reset at the leading edge of the reference clock signal and counting the sampling clocks outputted from the VCO 53 is produced, to find a count value from the time when the counter is reset to the time when it is then reset.

The count value and the frequency of the sampling clocks are in a proportional relationship. The higher the count value is, the higher the frequency of the sampling clocks is. Since the period of the reference clock signal is found, the frequency of the sampling clocks is found from the count value and the reference clock signal. The longer the period of the reference clock signal is, the higher the precision is. An object is not to find the accurate frequency of the sampling clocks but to find a unit amount of delay. Accordingly, approximately 30 μsec is sufficient as the period of the reference clock signal.

When the frequency of the sampling clocks is found by the clock frequency conversion unit 72, the delay data generation unit 73 finds the period T of the sampling clocks, to determine the unit amount of delay by the number of times of delay N previously set. That is, a unit amount of delay Δd is found on the basis of the following equation (2):

$$\Delta d = T/N \quad (2)$$

It is assumed that the number of times of delay N is set to eight. When the frequency of the sampling clocks which is calculated by the clock frequency conversion unit 72 is 20 MHZ (the period is 50 [ns]), for example, the unit amount of delay is 6.25 [ns]. The delay data generation unit 73 controls, every time a vertical signal is inputted, an amount of delay in the delay circuit 74 such that the phase of the horizontal synchronizing signal outputted from the delay circuit 74 is shifted 6.25 [ns] at a time.

When the frequency of the sampling clocks which has been calculated by the clock frequency conversion unit 72 is 125 MHZ (the period is 8 [ns], for example, the unit amount of delay is 1 [ns]. The delay data generation unit 73 controls, every time the vertical signal is inputted, the amount of delay in the delay circuit 74 such that the phase of the horizontal synchronizing signal outputted from the delay circuit 74 is shifted 1 [ns] at a time.

The sampling clock adjustment circuit is characterized in that the threshold value for end position judgment which is used in the horizontal video start/end detection circuit 61 is changed depending on the level of the input video signal, thereby shortening the detection time without degrading the precision. The characteristics will be described below.

Figure 4:
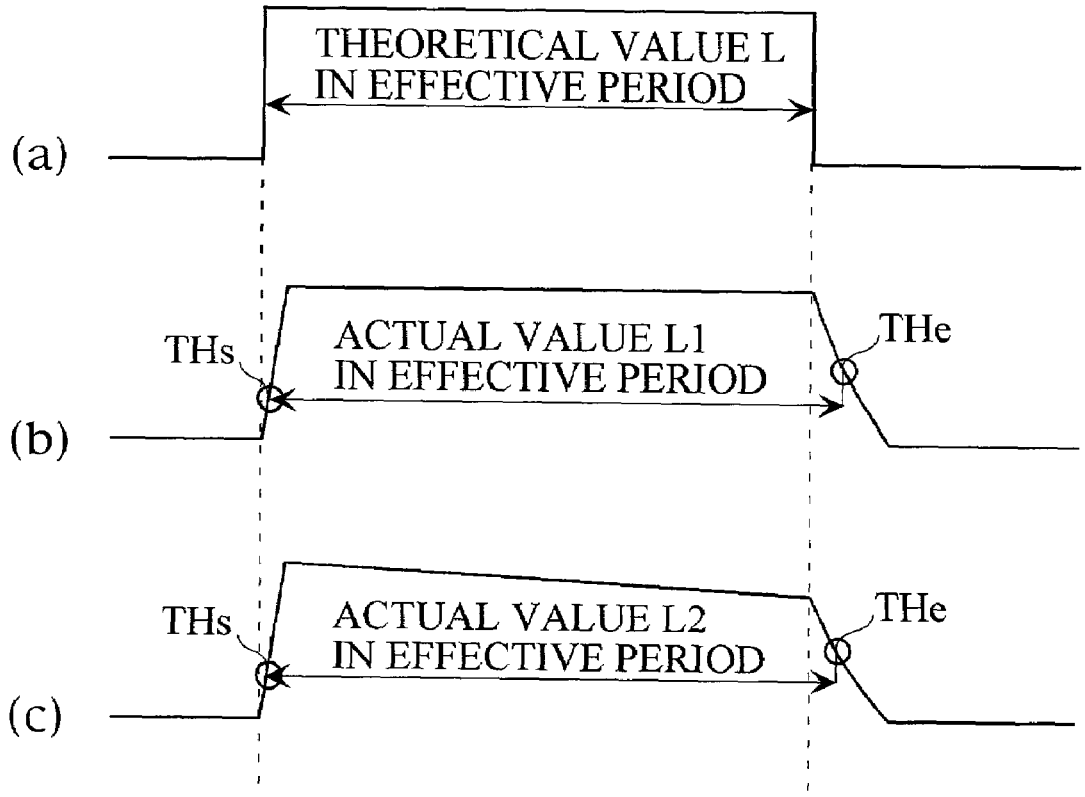
FIG. 4 is a schematic view showing a threshold value for end position judgment which is set by the first embodiment.

FIG. 4 illustrates a horizontal video effective period (the number of horizontal effective dots) detected by the sampling clock adjustment circuit according to the above-mentioned embodiment.

Figure 5:
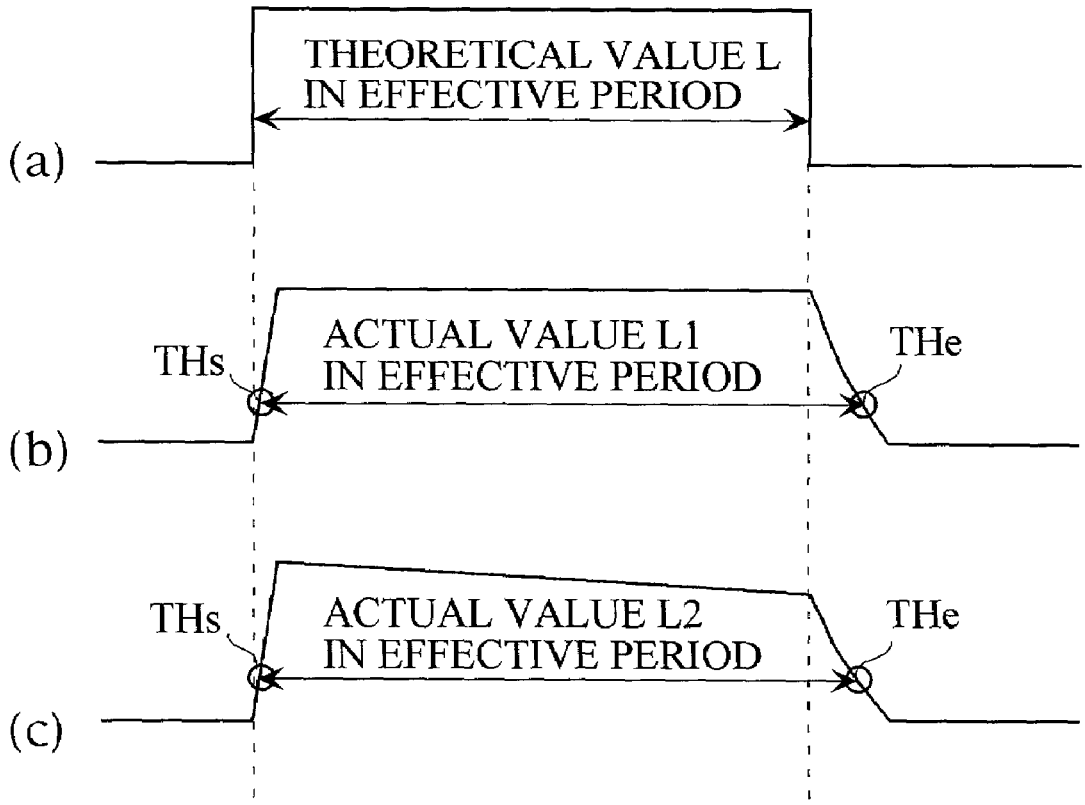
FIG. 5 is a schematic view showing a conventional threshold value for end position judgment.

FIG. 5 illustrates a horizontal video effective period (the number of horizontal effective dots) detected by the conventional sampling clock adjustment circuit.

In FIGS. 4 and 5, a signal (a) indicates an ideal analog input video signal which is not dull. A signal (b) or a signal (c) indicates an actual analog input video signal which is dull. This example shows a case where the dullness appears more significantly at the time of the fall than that at the time of the rise as indicated by the signal (b) or (c). THs and THe respectively indicate a threshold value for start position judgment and a threshold value for end position judgment.

In the conventional sampling clock adjustment circuit, the threshold value for start position judgment THs and the threshold value for end position judgment THe are the same, as shown in FIG. 5. The threshold values are set to small values in conformity with a case where the input video signal is a signal having a low luminance. Accordingly, horizontal video effective periods L1 and L2 actually detected are significantly longer than a theoretical value L in the horizontal video effective period. That is, the detection precision of the number of horizontal effective dots is lowered. Even if the detection precision of the number of horizontal effective dots is lowered, an adjustment unit at the time of fine phase adjustment must be fine in order to generate sampling clocks having as suitable a frequency as possible with respect to the input video signal, so that a time period required for the fine adjustment is lengthened.

Contrary to this, in the sampling clock adjustment circuit in the above-mentioned embodiment, the threshold value for end position judgment THe which is used for detecting the horizontal video end position is changed depending on the level of the input video signal, as shown in FIG. 4. Therefore, the threshold value for end position judgment THe need not be set in conformity with a case where the input video signal is a signal having a low luminance, and can be set to a large value. As a result, horizontal video effective periods L1 and L2 which are actually detected are values close to the theoretical value L in the horizontal video effective period than that in the conventional example.

This means that the necessity of fine phase adjustment is reduced and the adjustment unit at the time of fine phase adjustment can be reduced, thereby making it possible to improve the adjustment precision as well as to shorten the adjustment time.

The operations of the threshold value control unit 67 for controlling the threshold value for end position judgment THe will be described in detail.

A horizontal synchronizing signal (an H signal) and a vertical synchronizing signal (a V signal) of the input video signal, output signals of the A/D converters 2R, 2G, and 2B, a horizontal video end signal from the horizontal video start/end detection circuit 61, a horizontal video end count value from the H counter 62, and a horizontal video end count value from the maximum hold unit 63 are inputted to the threshold value control unit 67.

The threshold value control unit 67 updates for each vertical period the threshold value for end position judgment THe which is used in the horizontal video start/end detection circuit 61 on the basis of the level of the input video signal in a case where the video end count value is the maximum within the vertical period. The operation of the threshold value control unit 67 is started before the operation for detecting the total of horizontal dots is started.

Figure 6:
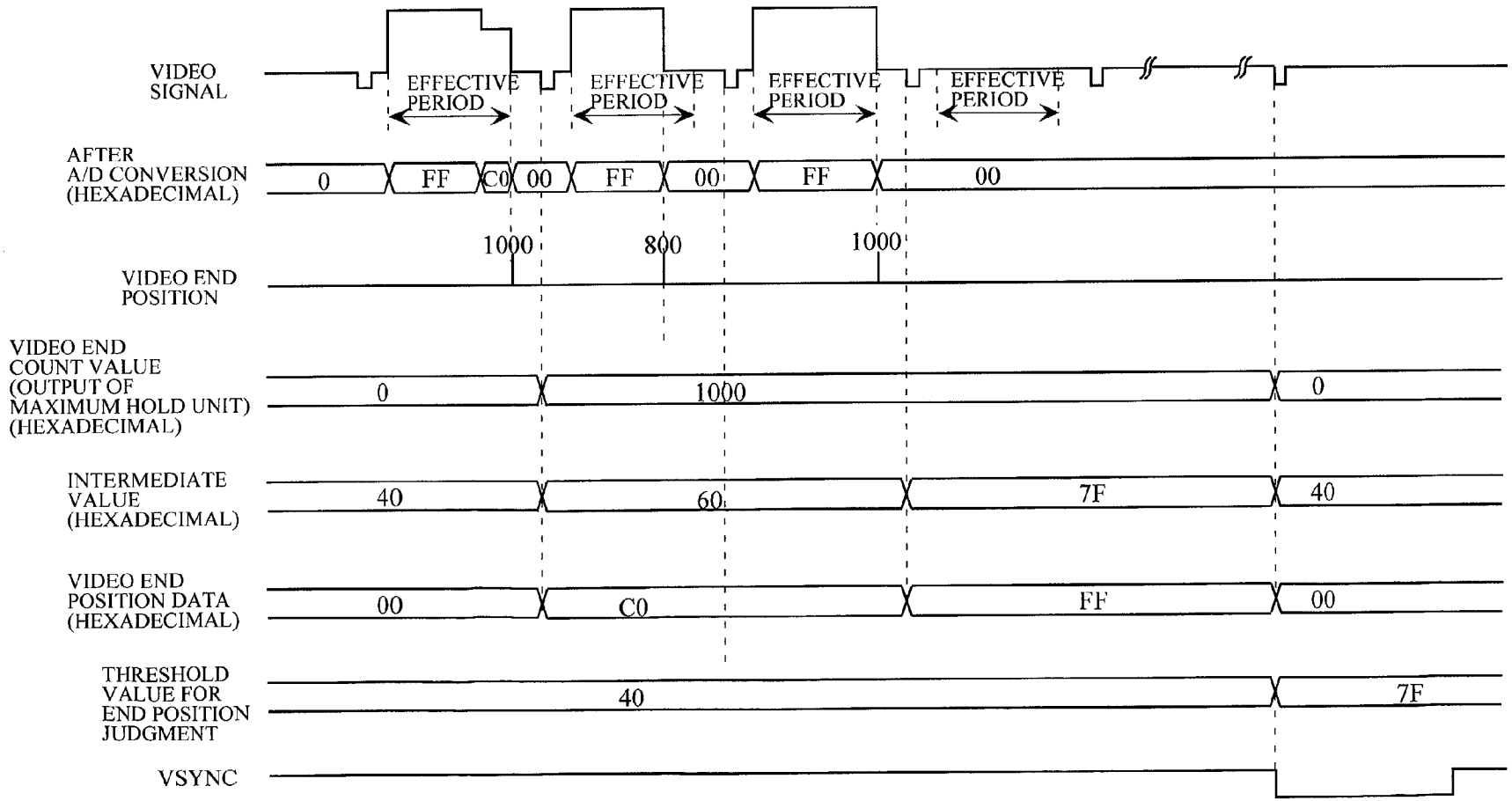
FIG. 6 is a timing chart for explaining the operation of a threshold value control unit 67.

A method of detecting the threshold value for end position judgment THe will be described using FIG. 6.

A threshold value calculated on the basis of the horizontal video end position detected by the horizontal video start/end detection circuit 61 within one vertical period shall be referred to as an intermediate threshold value. The threshold value for end position judgment THe is updated for each vertical period on the basis of an intermediate threshold value which has been calculated in the previous vertical period. The intermediate threshold value and the initial value of the threshold value for end position judgment THe shall be set to "40h " in hexadecimal. The intermediate threshold value is initialized so as to be an initial value every time the vertical synchronizing signal (the V signal) is outputted.

In principle, video data (outputs of the A/D converters 2R, 2G, and 2B) in a case where the horizontal video end position is detected by the horizontal video start/end detection circuit 61 for each horizontal period are acquired, and are stored as video end position data, to update the intermediate threshold value on the basis of the video end position data. The intermediate threshold value is set to a value which is one-half the video data, letting its minimum value be 40 h. The initial value of the video end position data is "00h", and the video end position data is initialized so as to be an initial value every time the vertical synchronizing signal is outputted.

There are exceptions, described below. As shown in FIG. 6, when an video end count value corresponding to the horizontal video end position detected by the horizontal video start/end detection circuit 61 is smaller than the video end count value held by the maximum hold unit 63, the detected horizontal video end position is not a true horizontal video end position, so that the acquired video data is not stored as video end position data. That is, the intermediate threshold value is not updated in this case.

When the vertical synchronizing signal is outputted, the intermediate threshold value held at that time point is outputted to the horizontal video start/end detection circuit 61 as the threshold value for end position judgment THe, and the intermediate threshold value and the video end position data are returned to their initial values.

By repeating the above-mentioned operations, the threshold value for end position judgment THe is updated every time the vertical synchronizing signal (the V signal) is outputted.

[2] Description of Second Embodiment

Referring now to FIGS. 7 to 10, a second embodiment of the present invention will be described.

The entire configuration of a liquid crystal display device is the same as that in the first embodiment (FIG. 2).

Figure 7:
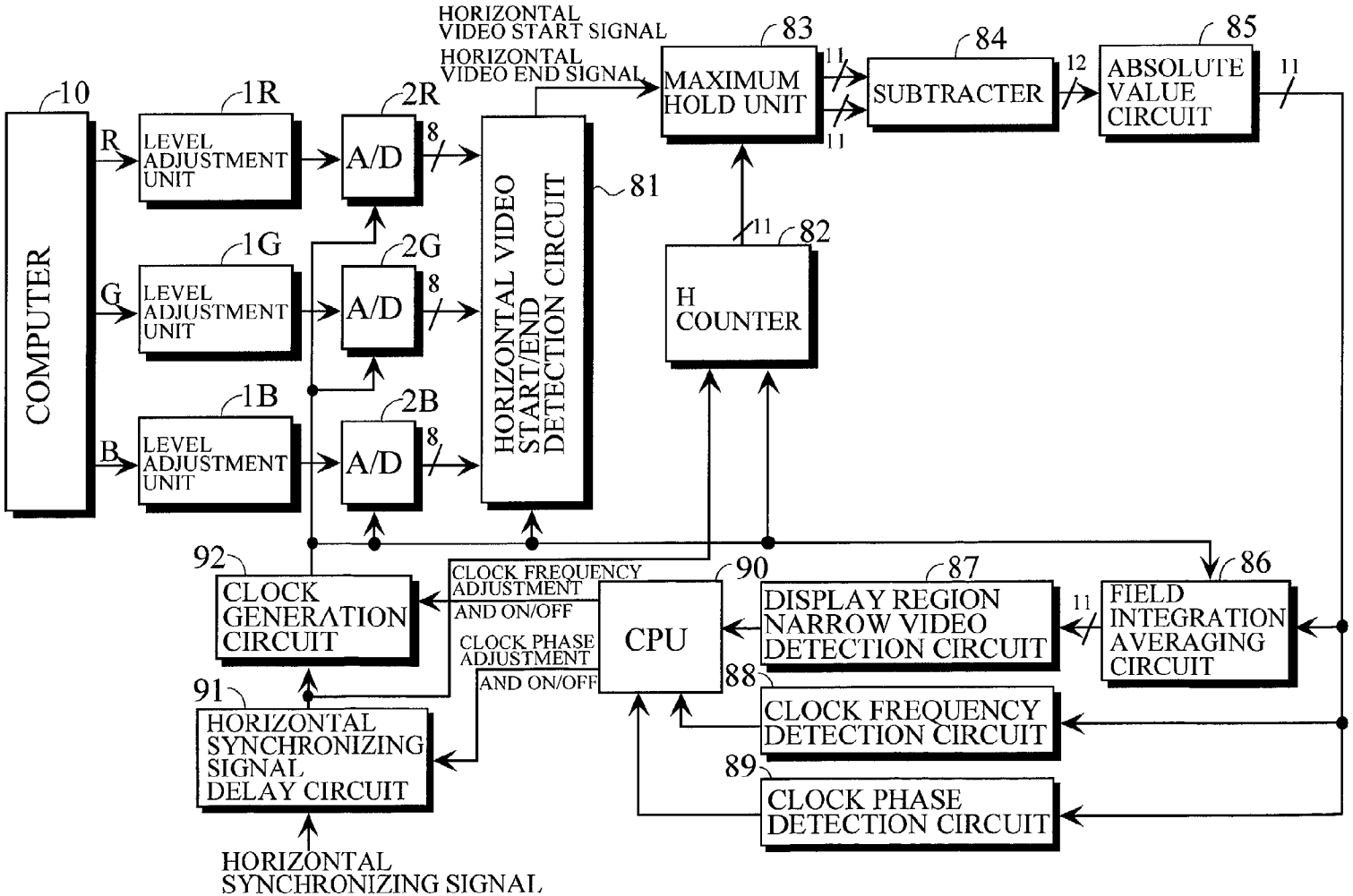
FIG. 7 is a block diagram showing the configuration of a sampling clock adjustment circuit according to a second embodiment.

FIG. 7 illustrates the configuration of a sampling clock adjustment circuit 40 (see FIG. 2)

The levels of video signals R, G, and B inputted to a liquid crystal display device from a computer 10 are respectively adjusted so as to conform to the input conditions of analog-to-digital (A/D) converters 2R, 2G, and 2B by level adjustment units 1R, 1G, and 1B. The signals R, G, and B whose levels have been adjusted are respectively converted into digital data R, G, and B by the A/D converters 2R, 2G, and 2B.

Sampling clocks corresponding to the A/D converters 2R, 2G, and 2B are generated by a clock generation circuit (a PLL circuit) 92. A horizontal synchronizing signal corresponding to an input video signal is fed to the clock generation circuit 92 through a horizontal synchronizing signal delay circuit 91. The clock generation circuit 92 generates the sampling clocks on the basis of the horizontal synchronizing signal outputted from the horizontal synchronizing signal delay circuit 91. The phase of the sampling clocks is adjusted by changing the amount of delay set in the horizontal synchronizing signal delay circuit 91.

The digital data R, G, and B obtained by the A/D converters 2R, 2G, and 2B are fed to a horizontal video start/end detection circuit 81. The horizontal video start/end detection circuit 81 is provided to detect a horizontal video start position and a horizontal video end position for each of horizontal lines on the basis of the data outputted from the A/D converters 2R, 2G, and 2B.

Specifically, the horizontal video start/end detection circuit 81 outputs, when each of the inputted data R, G, and B is changed from a level lower than a predetermined first threshold value (an video slice level higher than the first threshold value, a horizontal video start signal composed of a pulse signal corresponding to one sampling clock. After the horizontal video start signal is outputted by changing the inputted data from the level lower than the first threshold value to the level higher that the first threshold value, however, when the inputted data is maintained at the level higher than the first threshold value, no horizontal video start signal is outputted. After the horizontal video start signal is outputted, the inputted data is lower than the first threshold value and then exceeds the first threshold value, again, the horizontal video start signal is outputted again.

The horizontal video start/end detection circuit 81 outputs, when each of the inputted data R, G, and B is changed from a level higher than a predetermined second threshold value to a level lower than the second threshold value, a horizontal video end signal composed of a pulse signal corresponding to one sampling clock. The horizontal video start signal and the horizontal video end signal which are outputted from the horizontal video start/end detection circuit 81 are fed to the maximum hold unit 83.

When large values are respectively set as the first and second threshold values, data having a low luminance cannot be read. When small values are respectively set as the first and second threshold values, noises may be read as data. Therefore, such small values as to be slightly larger than the value of the noises are respectively set as the first and second threshold values.

An H counter 82 counts the number of sampling clocks inputted to the H counter 82. The H counter 82 is reset every time the horizontal synchronizing signal is inputted from the horizontal synchronizing signal delay circuit 91. Consequently, the H counter 82 counts the number of sampling clocks outputted from the clock generation circuit 92 for each horizontal period. A count value of the H counter 82 is fed to a maximum hold unit 83.

The maximum hold unit 83 holds the minimum value of count values of the H counter 82 in a case where a horizontal video start signal is inputted (hereinafter referred to as a horizontal video start count value). The maximum hold unit 83 holds the maximum value of count values of the H counter 82 in a case where a horizontal video end signal is inputted (hereinafter referred to as a horizontal video end count value). The maximum hold unit 83 feeds for each field the horizontal video start count value and the horizontal video end count value to a subtracter 84. The maximum hold unit 83 is reset for each field.

The subtracter 84 calculates for each vertical period the difference between the horizontal video start count value and the horizontal video end count value which are fed for each field from the maximum hold unit 83, and outputs the result of the operation to an absolute value circuit 85. The absolute value circuit 85 outputs the absolute value of the result of the operation obtained by the subtracter 84.

An output of the absolute value circuit 85 is fed to a field integration averaging circuit 86, a clock frequency detection circuit 88, and a clock phase detection circuit 89.

The clock frequency detection circuit 88 is a circuit for detecting whether or not the frequency of the sampling clocks is the most suitable value at the time of automatically adjusting the frequency of the sampling clocks. The clock frequency detection circuit 88 compares an output value of the absolute value circuit 85 with a predetermined number of horizontal effective pixels, to instruct a CPU 90 to increase the frequency of the sampling clocks if the output value of the absolute value circuit 85 is smaller than the number of horizontal effective pixels, while instructing the CPU 90 to decrease the frequency of the sampling clocks if the output value of the absolute value circuit 85 is larger than the number of horizontal effective pixels.

The CPU 90 controls the clock generation circuit 92 in response to the instruction from the clock frequency detection circuit 88. Consequently, the frequency of the sampling clocks is adjusted such that the output value of the absolute value circuit 85 coincides with the number of horizontal effective pixels The clock phase detection circuit 89 is a circuit for detecting whether or not the phase of the sampling clocks is in the most suitable state at the time of automatically adjusting the phase of the sampling clocks. The clock phase detection circuit 89 changes for each field the amount of delay in the horizontal synchronizing signal delay circuit 91 a predetermined amount at a time, and detects the best point of the phase of the clocks on the basis of the change in the difference between the horizontal video start count value and the horizontal video end count value, to issue an instruction to the CPU 90.

The CPU 90 controls the amount of delay in the horizontal synchronizing signal delay circuit 91 in response to the instruction from the clock phase detection circuit 89, to adjust the phase of the sampling clocks. The details of the clock phase detection circuit 89 will be described later.

The field integration averaging circuit 86 calculates for each filed the average of output values of the absolute value circuit 85 in order to increase the reliability of the result of the output of the absolute value circuit 85, and prevent an erroneous operation from being immediately performed by noises or the like. That is, the average of the output values outputted from the absolute value circuit 85 is found, thereby calculating the average of the output values of the absolute value circuit 85 per field.

The average of the output values of the absolute value circuit 85 per field which are outputted from the field integration averaging circuit 86 is fed to a display region narrow video detection circuit 87. The display region narrow video detection circuit 87 compares the average fed from the field integration averaging circuit 86 with a reference value, to judge whether the input video is narrow video (including a screen saver image) or normal video. The narrow video means such video that the width of a region where the video exists is smaller than the number of horizontal effective pixels. As the reference value, a value smaller by a predetermined number than the number of horizontal effective pixels is used.

The result of the judgment by the display region narrow video detection circuit 87 is fed to the CPU 90. At the time of automatically adjusting the clock frequency, the CPU 90 performs a clock frequency adjustment operation for the clock generation circuit 92 when the narrow video is not detected by the display region narrow video detection circuit 87, while stopping the clock frequency adjustment operation when the narrow video is detected by the display region narrow video detection circuit 87.

Similarly, at the time of automatically adjusting the phase of the clocks, the CPU 90 performs a clock phase adjustment operation for the horizontal synchronizing signal delay circuit 91 when the narrow video is not detected by the display region narrow video detection circuit 87, while stopping the clock phase adjustment operation for the horizontal synchronizing signal delay circuit 91 when the narrow video is detected by the display region narrow video detection circuit 87.

The display region narrow video detection circuit 87 is characterized not by merely detecting moving video but in that it is possible to judge video whose horizontal video start position and horizontal video end position which are information required to adjust sampling clocks are difficult to detect and particularly, a lot of narrow videos which are seen on the screen saver image. Of course, it is clear that a horizontal RAMP image and a solid black image can be detected as narrow videos.

Figure 8A:
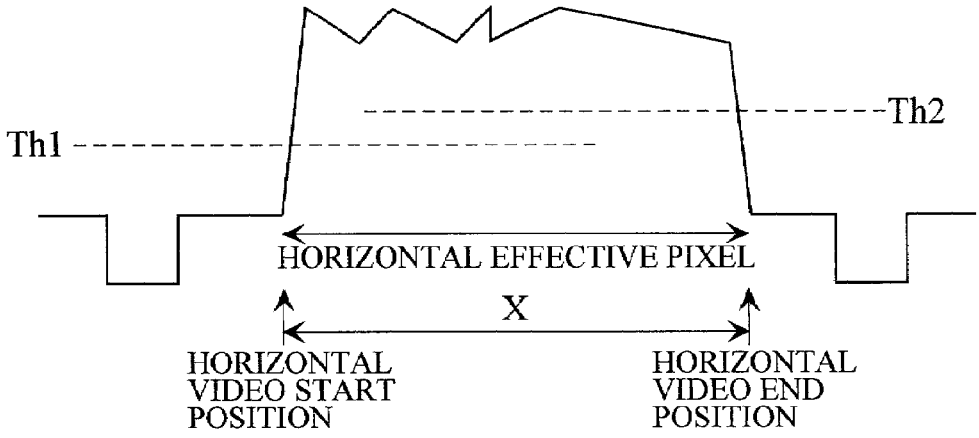
FIGS. 8*a*, 8*b*, and 8*c* are schematic views showing a horizontal video start position, a horizontal video end position, and horizontal effective pixels which correspond to each type of input signal.

In a case where a normal video signal as shown in FIG. 8*a* is inputted, when Th1 is taken as a first threshold value and Th2 is taken as a second threshold value, an output value (the difference between the horizontal video start count value and the horizontal video end count value) X outputted from the absolute value circuit 85 coincides with the number of horizontal effective pixels.

Figure 8B:
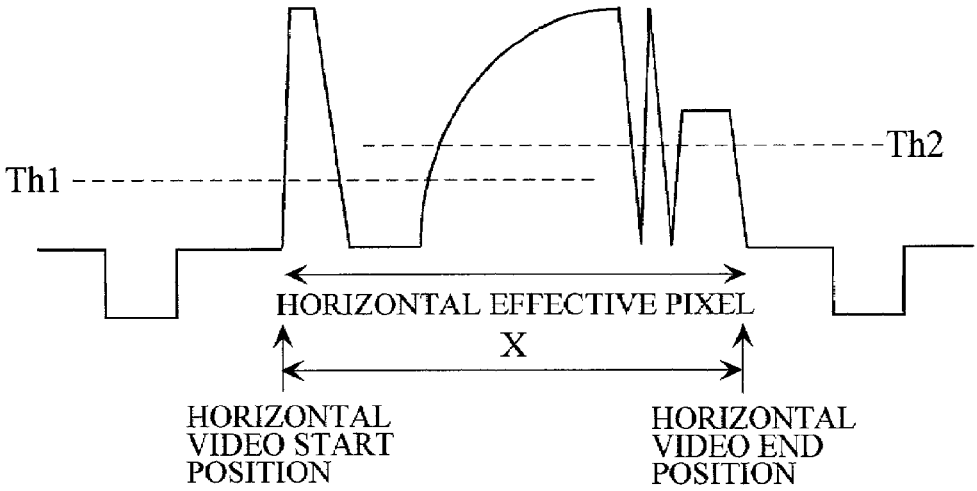

Even when a video signal which changes across two threshold levels is inputted within a horizontal effective video period, as shown in FIG. 8*b*, a horizontal video start count value corresponding to a horizontal video start position first detected and a horizontal video end count value corresponding to a horizontal video end position finally detected are held by the maximum hold unit 83. Accordingly, the output value X outputted from the absolute value circuit 85 coincides with the number of horizontal effective pixels.

Figure 8C:
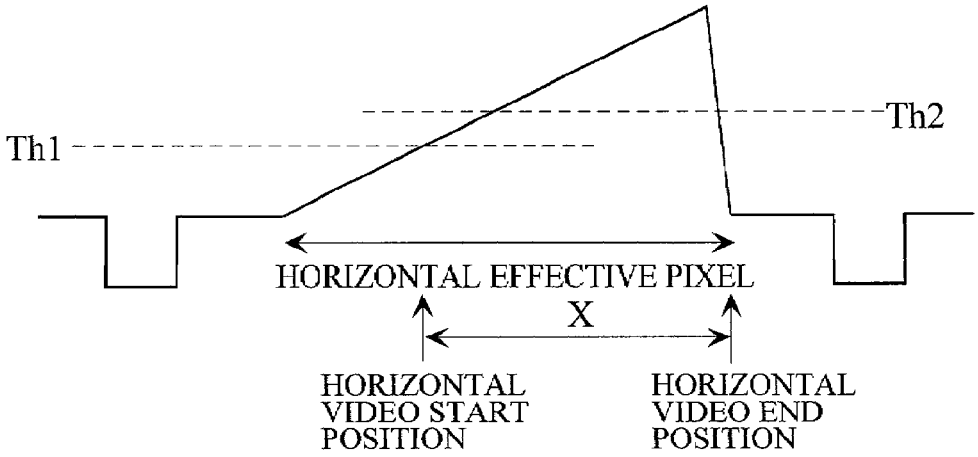

When a video signal representing a horizontal RAMP image as shown in FIG. 8*c* is inputted, the video signal has no sharp edge for specifying a horizontal video start position and is easily affected by noises. Accordingly, the horizontal video start position becomes unstable. Consequently, the output value (the difference between the horizontal video start count value and the horizontal video end count value) X outputted from the absolute value circuit 85 is smaller than the number of horizontal effective pixels, so that accurate clock adjustment cannot be performed. When such a horizontal RAMP image is inputted, the display region narrow video detection circuit 87 detects the inputted video as narrow video, so that the clock adjustment operation is stopped.

Description is made of the clock phase detection circuit 89. At the time of automatic clock phase adjustment, the clock phase detection circuit 89 changes for each field the amount of delay in the horizontal synchronizing signal delay circuit 91 a predetermined amount at a time, to detect the best point of the phase of the clocks on the basis of the change in the difference between the horizontal video start count value and the horizontal video end count value.

Figure 10:
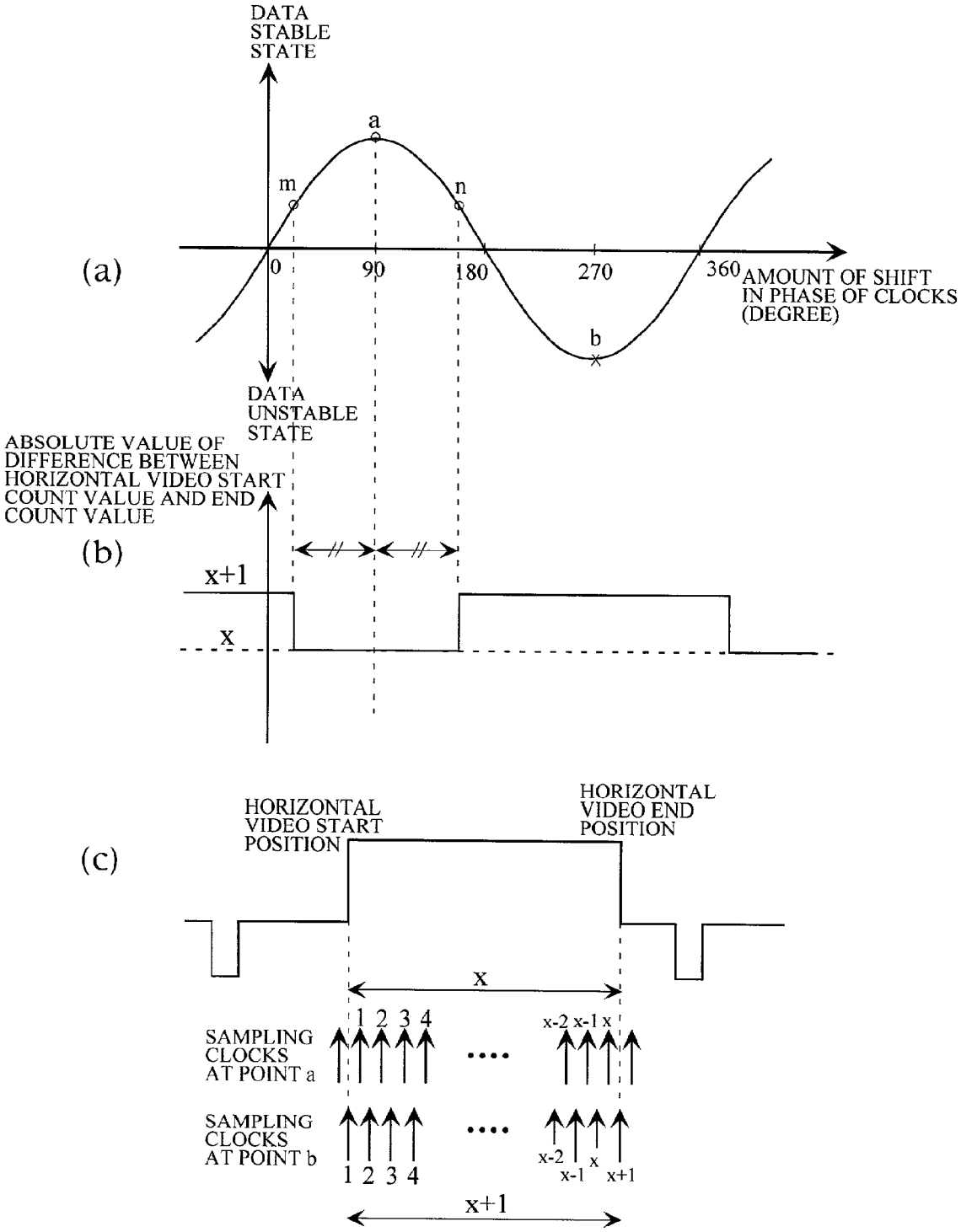
FIG. 10 is an illustration for explaining the principle for detecting the best point of the phase of sampling clocks.

Description is made of the principle for detecting the best point of the phase of the clocks on the basis of FIG. 10.

FIG. 10(*a*) shows how the relationship between pixels composing an input video signal and the phase of the clocks enters a data stable state or a data unstable state when the phase of the clocks is changed.

A point a is the best point of the phase of the clocks and is a point at which video data sampled by the A/D converters 2R, 2G, and 2B are best stabilized. When the phase of the clocks is gradually shifted from the point a, the data sampled by the A/D converters 2R, 2G, and 2B are unstable and are most unstable at a point b.

FIG. 10(*a*) shows an example in which an SIN waveform is used as a change curve representing a data stable state in order to make understanding easy, and a point having a phase of 90 degrees is taken as the best point. However, the change curve is changed by setting the frequency of the clocks, the amount of clock jitter, and the video slice level. In the change curve representing the data stable state, however, the vicinity of the point a which is the best point is always a smooth curve. Accordingly, it can be understood that the vertex of the curve, that is, the best point a is difficult to find.

FIG. 10(*b*) shows how the absolute value of the difference between the horizontal video start count value and the horizontal video end count value changes in a case where the phase of the clocks is changed in the forward direction.

As can be seen from FIG. 10(*b*), the absolute value decreases from the previous value (x+1) to x at a point m, while increasing from the previous value x to (x+1) at a point n. The peculiar points m and n at which the absolute value changes are positioned an equal distance apart, centered at the best point a.

As shown in FIG. 10(*c*), the absolute value in the vicinity of the point b at which the phase of the clocks is unstable is (x+1), as compared with the absolute value x in the vicinity of the best point a of the phase of the clocks. If an intermediate point between the point m and the point n which are within a range in which the absolute value is x and are the peculiar points is found, therefore, the best point a of the phase of the clocks can be found.

Figure 9:
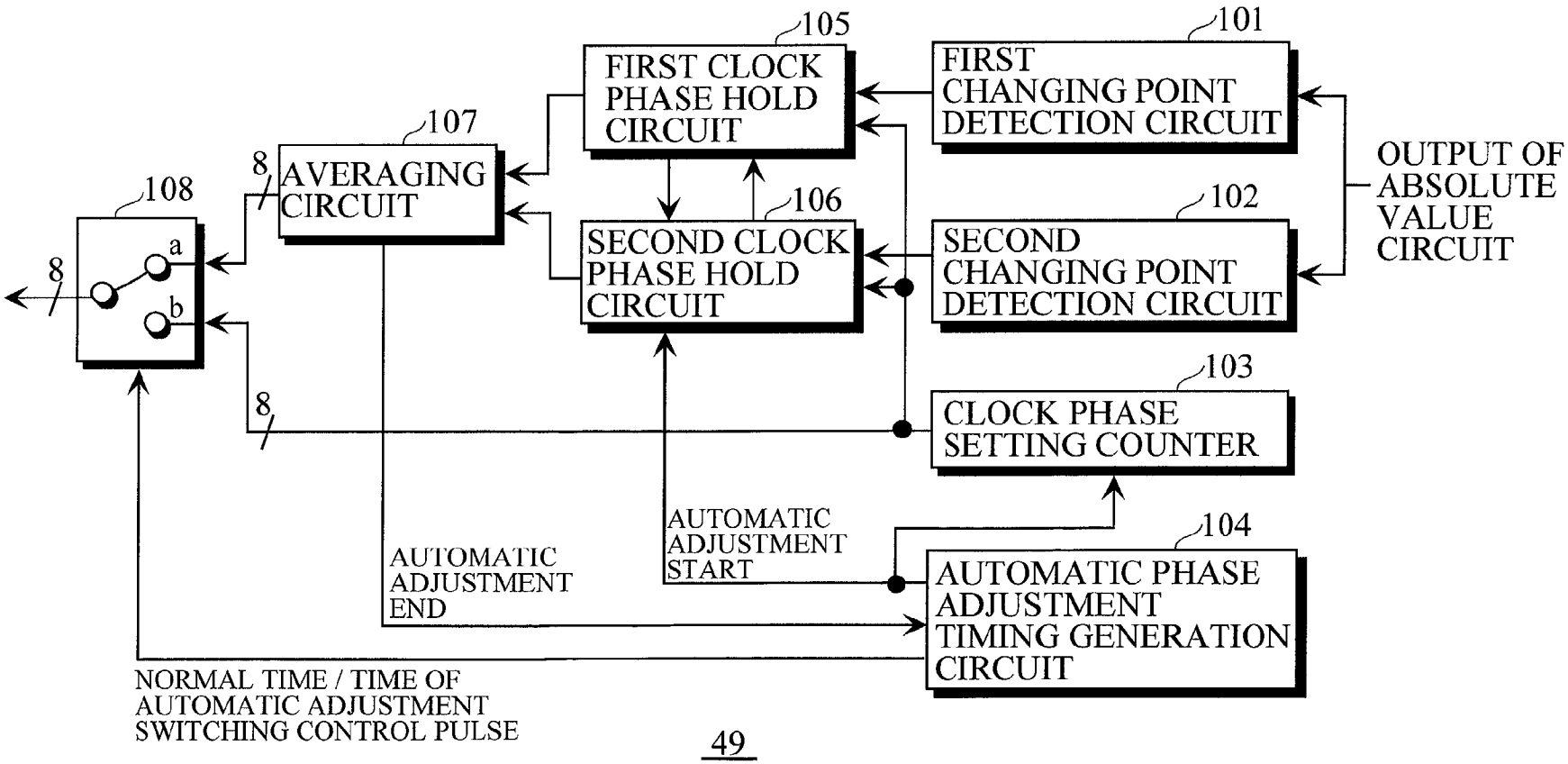
FIG. 9 is a block diagram showing the configuration of a clock phase detection circuit.

FIG. 9 illustrates the configuration of the clock phase detection circuit.

An automatic phase adjustment timing generation circuit 104 outputs an automatic adjustment start signal in cases such as a case where it is detected that an input signal to a liquid crystal display device, for example, is switched or a case where an automatic adjustment command is entered by an operator.

A default value is initially set in a clock phase setting counter 103. When an automatic adjustment start signal is inputted, the count value of the clock phase setting counter 103 is incremented by one for each vertical blacking period of the input video signal. Although a switching circuit 108 is always switched toward a contact a, it is switched toward a contact b at the time of automatic adjustment.

The count value of the clock phase setting counter 103 is inputted to the CPU 90 through the switching circuit 108. The CPU 90 feeds, when a narrow video is not detected by the display region narrow video detection circuit 87, the count value of the clock phase setting counter 103 which has been fed from the switching circuit 108 to the horizontal synchronizing signal delay circuit 91.

The horizontal synchronizing signal delay circuit 91 delays the horizontal synchronizing signal by an amount of delay corresponding to the count value of the clock phase setting counter 103 which has been fed from the CPU 90.

A first change point detection circuit 101 detects a first change point (the point m in FIG. 10(*a*)) at which the absolute value outputted from the absolute value circuit 85 decreases from the previous value. A first clock phase hold circuit 105 holds the count value of the clock phase setting counter 103 which has been set in the horizontal synchronizing signal delay circuit 91 in a field where the first change point is detected by the first change point detection circuit 101.

A second change point detection circuit 102 detects a second change point (the point n in FIG. 10(*a*)) at which the absolute value outputted from the absolute value circuit 85 increases from the previous value. A second clock phase hold circuit 106 holds the count value of the clock phase setting counter 103 which has been set in the horizontal synchronizing signal delay circuit 91 in a field where the second change point is detected by the second change point detection circuit 102.

An averaging circuit 107 calculates, when a count value (a first count value) held in the first clock phase hold circuit 105 and a count value (a second count value) held in the second clock phase hold circuit 106 satisfy such a relationship that the second count value is larger than the first count value, the average sum of the first count value and the second count value, and outputs an automatic phase adjustment end signal.

The reason why the automatic phase adjustment is terminated when the count value (the first count value) held in the first clock phase hold circuit 105 and the count value (the second count value) held in the second clock phase hold circuit 106 satisfy such a relationship that the second count value is larger than the first count value is that when the second change point (the point n shown in FIG. 10(*a*)) is detected before the first change point (the point m shown in FIG. 10(*a*)) and then, the first change point is detected, the automatic adjustment is maintained until the second change point is then detected.

When the automatic phase adjustment end signal is outputted, the switching circuit 108 is returned toward the contact a, and a value calculated by the averaging circuit 107 is fed to the horizontal synchronizing signal delay circuit 91 through the CPU 90 as a most suitable delay set value (clock phase set value). The automatic phase adjustment is terminated.

The clock phase detection circuit 89 is characterized not by utilizing the level value of the input video signal as it is but in that peculiar points of the phase of the sampling clocks outputted from the horizontal video start position to the horizontal video end position are detected on the basis of the number of the sampling clocks.

According to the clock phase detection circuit 89, the best phase of the clocks can be stably detected irrespective of the contents of video and the frequency characteristics of an analog waveform, that is, data in the vicinity of a white level and the vicinity of a black level of a video signal which is easily affected by overshoot strain and ringing strain. Further, data at both the start position and the end position of the horizontal video are utilized, thereby making it possible to absorb a subtle difference in the phase of the clocks between a left part and a right part of the video and to detect the uniform and best phase of the clocks on the entire screen.

According to the above-mentioned embodiment, it is possible to judge that the input video is switched to the narrow video and stop the automatic adjustment operation of the frequency of the sampling clocks or the phase of the sampling clocks. Accordingly, the automatic adjustment operation of the sampling clocks is not erroneously performed, the most stable phase relationship is kept between pixel data representing the video signal and the sampling clocks, and it is possible to display the stable video on a pixel corresponding panel.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A display device comprising:

a clock generation circuit for generating sampling clocks, whose frequency is controlled on the basis of a required frequency control value, on the basis of a horizontal synchronizing signal of an input video signal;

an analog-to-digital converter for sampling the input video signal on the basis of the sampling clocks generated from the clock generation circuit;

horizontal video start position detection means for detecting a horizontal video start position of video data outputted from the analog-to-digital converter on the basis of a first threshold value;

horizontal video end position detection means for detecting a horizontal video end position of the video data outputted from the analog-to-digital converter on the basis of a variable second threshold value;

calculation means for calculating the number of sampling clocks corresponding to the distance from the horizontal video start position to the horizontal video end position;

judgment means for judging whether or not the result of the calculation by the calculation means coincides with a required reference value;

frequency control value adjustment means for calculating, when it is judged that the result of the calculation by the calculation means and the reference value do not coincide with each other, a new frequency control value on the basis of the result of the calculation by the calculation means, the reference value, and the frequency control value currently set in the clock generation circuit, to feed the new frequency control value to the clock generation circuit; and threshold value control means for controlling, for each vertical period, the variable second threshold value depending on the level of the video data at the horizontal video end position detected within the vertical period.

2. The display device according to claim 1, wherein the clock generation circuit comprises a voltage controlled oscillator for outputting the sampling clocks, a frequency divider for dividing the frequency of the sampling clocks outputted from the voltage controlled oscillator, phase detection means, to which an output of the frequency divider and the horizontal synchronizing signal of the input video signal are inputted, for outputting a detection signal corresponding to the phase difference between both the inputted signals, and filter means for integrating the detection signal outputted from the phase detection means, to output the integrated detection signal to the voltage controlled oscillator, the frequency division ratio of the frequency divider being used as the frequency control value.

3. A display device comprising:

a clock generation circuit for generating sampling clocks, whose frequency is controlled on the basis of a required frequency control value, on the basis of a horizontal synchronizing signal of an input video signal;

an analog-to-digital converter for sampling the input video signal on the basis of the sampling clocks generated from the clock generation circuit;

a horizontal video start position detection circuit for detecting a horizontal video start position of video data outputted from the analog-to-digital converter on the basis of a first threshold value;

a horizontal video end position detection circuit for detecting a horizontal video end position of the video data outputted from the analog-to-digital converter on the basis of a variable second threshold value;

a calculation circuit for calculating the number of sampling clocks corresponding to the distance from the horizontal video start position to the horizontal video end position;

a judgment circuit for judging whether or not the result of the calculation by the calculation means coincides with a required reference value;

a frequency control value adjustment circuit for calculating, when it is judged that the result of the calculation by the calculation circuit and the reference value do not coincide with each other, a new frequency control value on the basis of the result of the calculation by the calculation circuit, the reference value, and the frequency control value currently set in the clock generation circuit, to feed the new frequency control value to the clock generation circuit; and a threshold value control means for controlling, for each vertical period, the variable second threshold value depending on the level of the video data at the horizontal video end position detected within the vertical period.

4. The display device according to claim 3, wherein the clock generation circuit comprises a voltage controlled oscillator for outputting the sampling clocks, a frequency divider for dividing the frequency of the sampling clocks outputted from the voltage controlled oscillator, a phase detection circuit, to which an output of the frequency divider and the horizontal synchronizing signal of the input video signal are inputted, for outputting a detection signal corresponding to the phase difference between both the inputted signals, and a filter circuit for integrating the detection signal outputted from the phase detection circuit, to output the integrated detection signal to the voltage controlled oscillator, the frequency division ratio of the frequency divider being used as a frequency control value.

5. A pixel corresponding display device comprising a clock generation circuit for generating sampling clocks on the basis of a horizontal synchronizing signal of an input video signal;

an analog-to-digital converter for sampling the input video signal on the basis of the sampling clocks generated from the clock generation circuit;

detection means for comparing video data outputted from the analog-to-digital converter with a predetermined threshold value, to detect a horizontal video start position and a horizontal video end position on each of horizontal lines;

calculation means for calculating, on the basis of a horizontal video start position closest to a horizontal period start position specified by the horizontal synchronizing signal out of horizontal video start positions detected within one field and a horizontal video end position farthest from the horizontal period start position specified by the horizontal synchronizing signal out of horizontal video end positions detected within one field, the number of sampling clocks corresponding to the distance between the horizontal video start position and the horizontal video end position of the input video signal for the field;

frequency adjustment means for controlling the clock generation circuit on the basis of the result of the calculation by the calculation means, to adjust the frequency of the sampling clocks;

judgment means for judging for each field whether or not the width of a region where input video exists is smaller than the number of horizontal effective pixels on the basis of the result of the calculation by the calculation means; and means for stopping, while the width of the region where the input video exists is being judged to be smaller than the number of horizontal effective pixels, a frequency adjustment operation based on the number of sampling clocks found in the field.

6. A pixel corresponding display device comprising:

a clock generation circuit for generating sampling clocks on the basis of a horizontal synchronizing signal of an input video signal;

an analog-to-digital converter for sampling the input video signal on the basis of the sampling clocks generated from the clock generation circuit;

a detection circuit for comparing video data outputted from the analog-to-digital converter with a predetermined threshold value, to detect a horizontal video start position and a horizontal video end position on each of horizontal lines;

a calculation circuit for calculating, on the basis of a horizontal video start position closest to a horizontal period start position specified by the horizontal synchronizing signal out of horizontal video start positions detected within one field and a horizontal video end position farthest from a horizontal period start position specified by the horizontal synchronizing signal out of horizontal video end positions detected within one field, the number of sampling clocks corresponding to the distance between the horizontal video start position and the horizontal video end position of the input video signal for the field;

a frequency adjustment circuit for controlling the clock generation circuit on the basis of the result of the calculation by the calculation circuit, to adjust the frequency of the sampling clocks;

a judgment circuit for judging for each field whether or not the width of a region where input video exists is smaller than the number of horizontal effective pixels on the basis of the result of the calculation by the calculation circuit; and a circuit for stopping, while the width of the region where the input video exists is being judged to be smaller than the number of horizontal effective pixels, a frequency adjustment operation based on the number of sampling clocks found in the field.

7. A pixel corresponding display device comprising:

a delay circuit, whose amount of delay is variable, for delaying and outputting a horizontal synchronizing signal of an input video signal;

a clock generation circuit for generating sampling clocks which are synchronized with the horizontal synchronizing signal outputted from the delay circuit;

an analog-to-digital converter for sampling the input video signal on the basis of the sampling clocks generated from the clock generation circuit;

detection means for comparing video data outputted from the analog-to-digital converter with a predetermined threshold value, to detect a horizontal video start position and a horizontal video end position on each of horizontal lines;

calculation means for calculating, on the basis of a horizontal video start position closest to a horizontal period start position specified by the horizontal synchronizing signal outputted from the delay circuit out of horizontal video start positions detected within one field and a horizontal video end position farthest from a horizontal period start position specified by the horizontal synchronizing signal outputted from the delay circuit out of horizontal video end positions detected within one field, the number of sampling clocks corresponding to the distance between the horizontal video start position and the horizontal video end position of the input video signal for the field;

phase adjustment means for changing an amount of delay set in the delay circuit a predetermined amount at a time for each field, to change the phase of the sampling clocks a predetermined amount at a time for the field, holding as a first amount of delay the amount of delay set in the delay circuit in the field in a case where the number of sampling clocks calculated by the calculation means is changed in such a direction as to be decreased and holding as a second amount of delay the amount of delay set in the delay circuit in the field in a case where the number of sampling clocks calculated by the calculation means is changed in such a direction as to be increased, and calculating the average sum of the first amount of delay and the second amount of delay, to set the amount of delay set in the delay circuit to the obtained average sum;

judgment means for judging for each field whether or not the width of a region where input video exists is smaller than the number of horizontal effective pixels on the basis of the result of the calculation by the calculation means; and means for stopping, when it is judged that the width of the region where the input video exists is smaller than the number of horizontal effective pixels, a phase adjustment operation based on the number of sampling clocks found in the field.

8. A pixel corresponding display device comprising:

a delay circuit, whose amount of delay is variable, for delaying and outputting a horizontal synchronizing signal of an input video signal;

a clock generation circuit for generating sampling clocks which are synchronized with the horizontal synchronizing signal outputted from the delay circuit;

an analog-to-digital convener for sampling the input video signal on the basis of the sampling clocks generated from the clock generation circuit;

a detection circuit for comparing video data outputted from the analog-to-digital converter with a predetermined threshold value, to detect a horizontal video start position and a horizontal video end position on each of horizontal lines;

a calculation circuit for calculating, on the basis of a horizontal video start position closest to a horizontal period start position specified by the horizontal synchronizing signal outputted from the delay circuit out of horizontal video start positions detected within one field and a horizontal video end position farthest from a horizontal period start position specified by the horizontal synchronizing signal outputted from the delay circuit out of horizontal video end positions detected within one field, the number of sampling clocks corresponding to the distance between the horizontal video start position and the horizontal video end position of the input video signal for the field;

a phase adjustment circuit for changing an amount of delay set in the delay circuit a predetermined amount at a time for each field, to change the phase of the sampling clocks a predetermined amount at a time for the field, holding as a first amount of delay the amount of delay set in the delay circuit in the field in a case where the number of sampling clocks calculated by the calculation means is changed in such a direction as to be decreased and holding as a second amount of delay the amount of delay set in the delay circuit in the field in a case where the number of sampling clocks calculated by the calculation circuit is changed in such a direction as to be increased, and calculating the average sum of the first amount of delay and the second amount of delay, to set the amount of delay set in the delay circuit to the obtained average sum;

a judgment circuit for judging for each field whether or not the width of a region where input video exists is smaller than the number of horizontal effective pixels on the basis of the result of the calculation by the calculation means; and a circuit for stopping, when it is judged that the width of the region where the input video exists is smaller than the number of horizontal effective pixels, a phase adjustment operation based on the number of sampling clocks found in the field.

* * * * *